United States Patent [19]

Wilson, Jr.

[11] Patent Number: 4,952,760

[45] Date of Patent: Aug. 28, 1990

[54] SWITCH COVER ARRANGEMENT

[75] Inventor: Edward M. Wilson, Jr., Eugene, Oreg.

[73] Assignee: Spectra-Physics, Inc., San Jose, Calif.

[21] Appl. No.: 298,045

[22] Filed: Jan. 18, 1989

[51] Int. Cl.[5] ..... H01H 9/04

[52] U.S. Cl. ..... 200/302.1; 200/341; 200/333; 200/332.1

[58] Field of Search ..... 200/302.1, 329, 333, 200/341, 345, 293, 294, 296, 338, 330, 332.1, 520, 517

[56] References Cited

U.S. PATENT DOCUMENTS

| | | | |
|---|---|---|---|
| 3,018,338 | 1/1962 | Mullen et al. | 200/302.1 |
| 3,305,660 | 2/1967 | Sohns et al. | 200/302.2 |
| 3,316,379 | 4/1967 | Clark et al. | 200/333 |
| 4,250,368 | 2/1981 | Johnston et al. | 200/296 |
| 4,480,163 | 10/1984 | Morris et al. | 200/332.1 |
| 4,678,879 | 7/1987 | Kenway | 200/296 |
| 4,716,262 | 12/1987 | Morse | 200/302.21 |
| 4,822,963 | 4/1989 | Martin | 200/296 |
| 4,825,023 | 4/1989 | Morse | 200/302.2 |

FOREIGN PATENT DOCUMENTS

| | | | |
|---|---|---|---|
| 198816 | 7/1958 | Austria | 200/302.2 |

*Primary Examiner*—Henry J. Recla
*Assistant Examiner*—Glenn T. Barrett
*Attorney, Agent, or Firm*—Killworth, Gottman, Hagan & Schaeff

[57] ABSTRACT

A switch cover arrangement for a push-botton electrical switch of the type having a switch actuation button, a switch body on which the button is mounted, and a pair of switch terminals mounted on the switch body protects the switch from its environment and prevents the application of excessive force to the switch actuation button. The switch cover arrangement includes a base plate to which the switch body is secured, and a housing to which the base plate is secured. The housing defines a central cavity for receiving the switch body and the switch button. The central cavity is closed at a first end by the base plate. The switch cover arrangement also includes a button cover mounted for sliding movement in the central cavity toward and away from the base plate. The button cover has a stop portion for contacting the base plate so as to limit sliding movement of the button cover in a direction toward the switch body.

13 Claims, 2 Drawing Sheets

SWITCH COVER ARRANGEMENT

BACKGROUND OF THE INVENTION

The present invention relates to a switch cover arrangement for a push-button electrical switch and, more particularly, to such a switch cover which provides protection for the push button switch from the environmental conditions in which it operates and at the same time prevents excessive force from being applied to the switch during its actuation.

Typically, a push-button electrical switch has a switch actuation button, a switch body on which the button is mounted, and a pair of switch terminals mounted on the switch body. Although generally reliable over a great many actuations and available at a reasonable cost, such electrical switches may not be readily used in a number of applications due to the harsh environmental conditions which are encountered. In a typical manufacturing setting, for example, dust and other particulate contaminants may be present to a degree that the operation of the switch will deteriorate over time. Furthermore, a relatively inexpensive push button electrical switch may be damaged if too great an actuation force is applied to the switch actuation button. Both of these difficulties may be reduced by utilizing specially designed switches, but such switches are relatively expensive, and may not be readily available.

It is seen, therefore, that a need exists for a switch cover arrangement which can be used to cover a switch, protecting the switch from environmental contaminants and from excessive actuation forces.

SUMMARY OF THE INVENTION

This need is met by a switch cover arrangement according to the present invention for a push-button electrical switch of the type having a switch actuation button, a switch body on which the button is mounted, and a pair of switch terminals mounted on the switch body. The cover arrangement protects the switch from its environment and prevents the application of excessive force to the switch actuation button. The cover arrangement includes a base plate to which the switch body is secured, the switch body extending through a central opening in the base plate, and a housing to which the base plate is secured, the housing defining a central cavity for receiving the switch body and the switch button. The central cavity is closed at a first end by the base plate. The cover arrangement further includes a button cover mounted for movement with the button in the central cavity and closing a second end thereof.

The switch cover arrangement may further comprise means for mounting the housing on a support surface. The base plate may define an opening in which the switch body is positioned. The housing may define a generally cylindrical central cavity, a central opening extending thereto, and a shoulder surrounding the opening. The button cover is positioned for sliding movement in the central opening of the housing, and includes means for contacting the shoulder so as to limit the range of sliding movement of the button cover away from the switch. The means for contacting the shoulder comprises an annular stop element extending circumferentially around the button cover.

The button cover defines a generally cylindrical recess therein for receiving the button of the switch. The generally cylindrical recess is of a depth such that sliding movement of the button cover toward the switch is limited by the button cover contacting the base plate.

The invention may be further summarized as a switch cover arrangement for a push-button electrical switch of the type having a switch actuation button, a switch body on which the button is mounted, and a pair of switch terminals mounted on the switch body. The cover arrangement protects the switch from its environment and prevents the application of excessive force to the switch actuation button. The switch cover arrangement includes a base plate to which the switch body is secured, and a housing to which the base plate is secured. The housing defines a central cavity for receiving the switch body and the switch button. The central cavity is closed at a first end by the base plate. The switch cover arrangement also includes a button cover mounted for sliding movement in the central cavity toward and away from the base plate. The button cover has a stop portion for contacting the base plate so as to limit sliding movement of the button cover in a direction toward the switch body.

The switch cover arrangement further includes means for mounting the housing on a support surface. The means for mounting the housing on a support surface comprises a plurality of mounting bolts extending through the housing and the base plate.

Accordingly, it is an object of the present invention to provide a switch cover arrangement for a push-button electrical switch of the type having a switch actuation button, a switch body on which the button is mounted, and a pair of switch terminals mounted on the switch body; to provide such a switch cover arrangement which protects the switch from its environment and prevents the application of excessive force to the switch actuation button; to provide such a cover arrangement including a base plate to which the switch body is secured with the switch body extending through a central opening in the base plate, and a housing to which the base plate is secured, the housing defining a central cavity for receiving the switch body and the switch button; to provide such a switch cover arrangement including a button cover mounted for movement with the button in the central cavity; and to provide such a switch cover arrangement in which the button cover has a stop portion for contacting the base plate so as to limit sliding movement of the button cover in a direction toward the switch body.

Other objects and advantages of the invention will be apparent from the following description, the accompanying drawings and the appended claims.

DETAILED DESCRIPTION OF THE PREFERRED EMBODIMENT

FIGS. 1-4 illustrate the improved switch cover arrangement of the present invention. This arrangement is specifically designed to protect a push-button electrical switch 10 of the type having a switch actuation button 12, a switch body 14 on which the button 12 is mounted, and a pair of switch terminals 16, also mounted on the switch body 14. The switching state of the switch 10 is changed by pressing the button 12 and moving it toward the body 14 by a predetermined distance. Typically, the button 12 is spring loaded such that it is urged to the position shown in FIG. 4.

Figure 4:
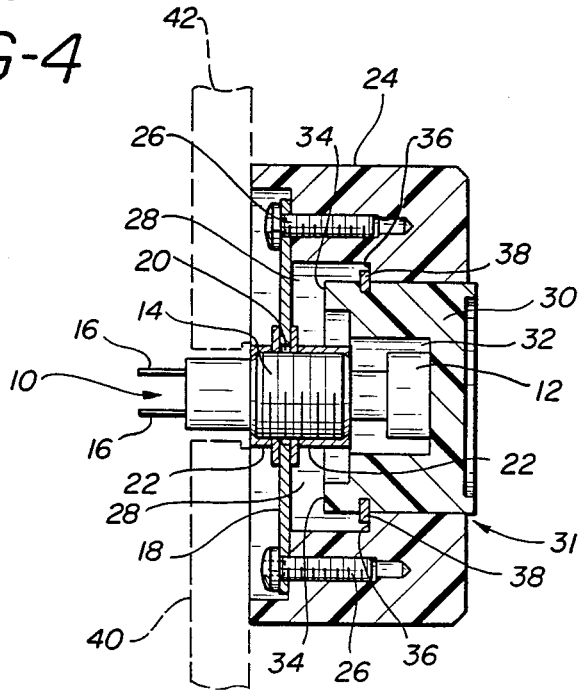
FIG. 4 is a sectional view, taken generally along line 4—4 in FIG. 2, also showing the support surface in dashed lines.

The cover arrangement includes a base plate 18, preferably made of aluminum, to which the switch body 14 is secured. As seen in FIG. 4, the switch body 14 has an exterior surface which is threaded. The switch body 14 is positioned to extend through a central opening 20 in the base plate 18. The switch body 14 is held in position by a pair of internally threaded nut elements 22 which engage opposite sides of the base plate 18.

The cover arrangement further includes a housing 24, preferably made of nylon, to which the base plate is secured by a pair of screws 26. The housing 24 defines a central cavity 28 for receiving the switch body 14 and the switch button 12. The central cavity 28 is closed at a first end by the base plate 18.

The cover arrangement further includes button cover 30, preferably made of polyethylene. The button cover 30 is mounted for movement with the button 12 in the central cavity 28 and effectively closes a central opening 31 at the second end of the cavity 28. The button cover 30 defines a generally cylindrical recess 32 therein for receiving the button 12 of the switch 10. The generally cylindrical recess 32 is of a depth such that sliding movement of the button cover 30 toward the switch 10 is limited by the button cover contacting the base plate 18. Specifically, the annular surface 34 defines a stop portion on the button cover 30 which is brought into contact with the base plate 18 when the button cover is fully pressed, the cover 30 and button 12 are moved toward the switch 10, and the switch 10 is actuated.

The housing 24 defines a shoulder 36 surrounding the opening 31. The button cover 30 is positioned for sliding movement in the central, cylindrical opening 31 of the housing 24, and includes means for contacting the shoulder 36 so as to limit the range of sliding movement of the button cover 30 in a direction away from the switch 10. The means for contacting the shoulder comprises an annular stop element 38, extending circumferentially around the button cover 30, which preferably takes the form of a snap ring.

Figure 1:
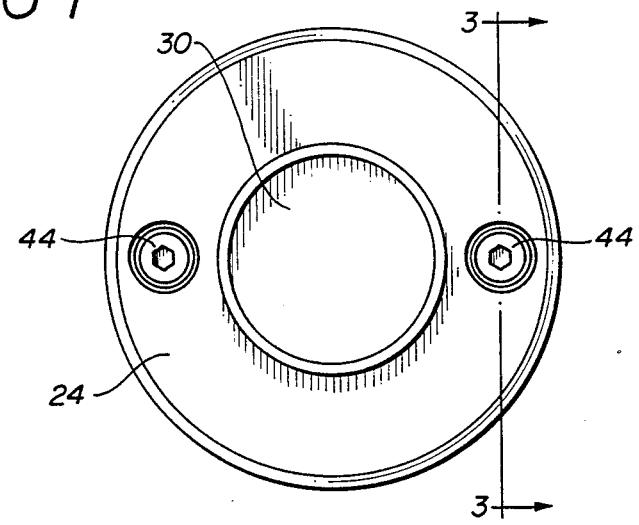
FIG. 1 is a front elevational view of the switch cover arrangement of the present invention.
Figure 2:
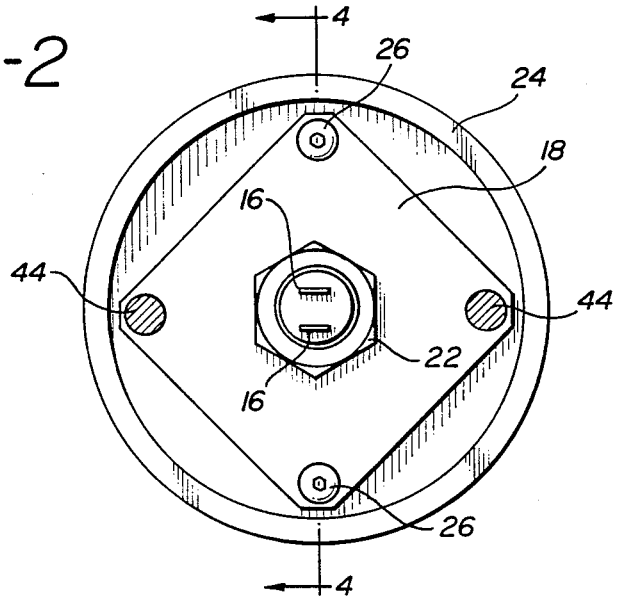
FIG. 2 is a rear elevational view of the switch cover arrangement of the present invention.
Figure 3:
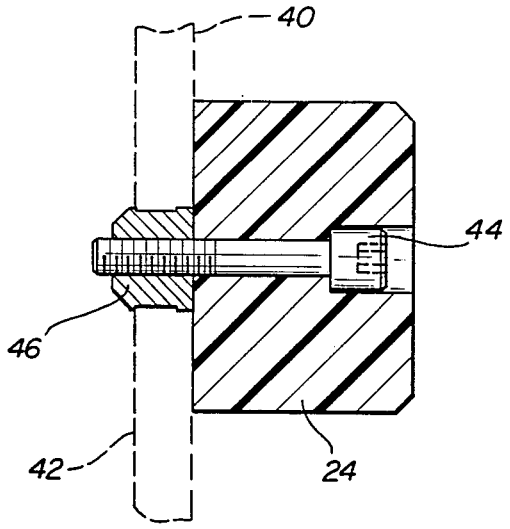
FIG. 3 is a sectional view of the switch cover arrangement, taken generally along line 3—3 in FIG. 1, showing the support surface in dashed lines.

The switch cover arrangement further includes means for mounting the housing 24 on a support surface 40 defined by panel 42, shown in FIGS. 3 and 4 in dashed lines. This means for mounting the housing 24 on support surface 40 may, for example, comprise mounting bolts 44 which extending through the housing 24 and the base plate 18, and engage panel 42 by means of expander nuts 46.

As will be appreciated, the cover arrangement of the present invention protects the switch 10 from dust and other contaminants which may be found in its working environment. Additionally, the cover arrangement limits the range of motion of cap 30 and thereby prevents the application of excessive force to the switch actuation button 12.

Having described the invention in detail and by reference to the preferred embodiment thereof, it will be apparent that other modifications and variations are possible without departing from the scope of the invention defined in the appended claims.

What is claimed is:

1. A switch cover arrangement for a push-button electrical switch of the type having a switch actuation button, a switch body on which the button is mounted, and a pair of switch terminals mounted on said switch body, said cover arrangement protecting said switch from its environment and preventing the application of excessive force to the switch actuation button, comprising:

a base plate to which said switch body is secured, said switch body extending through a central opening in said base plate, a housing to which said base plate is secured, said housing defining a central cavity, open at opposite ends, for receiving said switch body and said switch button, said central cavity being closed at a first end by said base plate, and a button cover mounted for movement with said button in said central cavity and closing a second end thereof, said button cover defining a generally cylindrical recess therein for receiving said button of said switch, said generally cylindrical recess being of a depth such that sliding movement of said button cover toward said switch is limited by said button cover contacting said base plate.

2. The switch cover arrangement of claim 1 for a push-button electrical switch, further comprising means for mounting said housing on a support surface.

3. The switch cover arrangement of claim 1 for a push-button electrical switch, in which said housing defines a generally cylindrical central cavity, a central opening extending thereto, and a shoulder surrounding said opening.

4. The switch cover arrangement of claim 3 for a push-button electrical switch in which said button cover is positioned for sliding movement in said central opening of said housing and includes means for contacting said shoulder so as to limit the range of sliding movement of said button cover away from said switch.

5. The switch cover arrangement of claim 4 for a push-button electrical switch in which said means for contacting said shoulder comprises an annular stop element extending circumferentially around said button cover.

6. A switch cover arrangement for a push-button electrical switch of the type having a switch actuation button, a switch body on which the button is mounted, and a pair of switch terminals mounted on said switch body, said cover arrangement protecting said switch from its environment and preventing the application of excessive force to the switch actuation button, comprising:

a base plate to which said switch body is secured, a housing to which said base plate is secured, said housing defining a central cavity open at opposite ends, for receiving said switch body and said switch button, said central cavity being closed at a first end by said base plate, and a button cover mounted for sliding movement in said central cavity toward and away from said base plate, said button cover defining a generally cylindrical recess therein for receiving said button of said switch, and having a stop portion for contacting said base plate so as to limit sliding movement of said button cover in a direction toward said switch body.

7. The switch cover arrangement of claim 6 for a push-button electrical switch, further comprising means for mounting said housing on a support surface.

8. The switch cover arrangement of claim 7 for a push-button electrical switch in which said means for mounting said housing on a support surface comprises a plurality of mounting bolts extending through said housing and said base plate.

9. The switch cover arrangement of claim 6 for a push-button electrical switch, in which said base plate defines an opening in which said switch body is positioned.

10. The switch cover arrangement of claim 6 for a push-button electrical switch, in which said housing defines a generally cylindrical central cavity, a central opening extending thereto, and a shoulder surrounding said opening.

11. The switch cover arrangement of claim 10 for a push-button electrical switch in which said button cover is positioned for sliding movement in said central opening of said housing and includes means for contacting said shoulder so as to limit the range of sliding movement of said button cover away from said switch.

12. The switch cover arrangement of claim 11 for a push-button electrical switch in which said means for contacting said shoulder comprises an annular stop element extending circumferentially around said button cover.

13. The switch cover arrangement of claim 6 for a push-button electrical switch in which said generally cylindrical recess is of a depth such that sliding movement of said button cover toward said switch is limited by said button cover contacting said base plate.

* * * * *